US005553331A

United States Patent [19]

Gentile

[11] Patent Number: 5,553,331

[45] Date of Patent: Sep. 10, 1996

[54] UNIVERSAL FIT FACE MASK

[76] Inventor: Robert Gentile, 30 Wyman St., Billerica, Mass. 01821

[21] Appl. No.: 146,329

[22] Filed: Nov. 2, 1993

[51] Int. Cl.[6] ..... A61F 9/02

[52] U.S. Cl. ..... 2/430; 2/451

[58] Field of Search ..... 2/428, 429, 430, 2/440, 441, 443, 447, 449, 450, 451, 452, 454, 9; 128/201.27, 201.12, 206.23, 206.24, 201.24

[56] References Cited

U.S. PATENT DOCUMENTS

| | | | |
|---|---|---|---|
| 857,689 | 6/1907 | Tileston | 2/454 |
| 1,161,061 | 11/1915 | Malcom | 2/439 |
| 2,307,419 | 1/1943 | McNeill et al. | 2/454 |
| 3,143,739 | 8/1964 | Beuchat | 2/428 |
| 3,186,005 | 6/1965 | Gentile | 2/428 |
| 4,112,521 | 9/1978 | Ulan | 2/452 |
| 4,674,136 | 6/1987 | Ladewig | 2/439 X |
| 4,856,120 | 8/1989 | Hart | 2/428 |
| 4,910,806 | 3/1990 | Baker et al. | 2/452 |
| 5,033,818 | 7/1991 | Barr | 2/428 |
| 5,111,536 | 5/1992 | Hunnebeck | 2/428 |

FOREIGN PATENT DOCUMENTS

| | | | |
|---|---|---|---|
| 1223569 | 2/1960 | France | 128/206.23 |
| 1261514 | 4/1961 | France | 2/430 |
| 0633640 | 2/1962 | Italy | 2/430 |

*Primary Examiner*—Peter Nerbun
*Attorney, Agent, or Firm*—Ellen C. Childress

[57] ABSTRACT

This diverse face mask has a frontal and two optional side self sealing lenses in a pliable mask body. Two pocket hinges are located on the sides of the mask. The Teat portion of the mask contacts the head behind the concave surface of the temple. The mask body contacting the head is concave, to act as a suction cup. A floating strap attached at the rear of the pocket hinge is provided to pull the posterior of the hinge and a posterior flap toward the body in order to provide a universal fit and water tight seal.

6 Claims, 3 Drawing Sheets

UNIVERSAL FIT FACE MASK

FIELD OF THE INVENTION

This invention relates to face masks used for underwater diving.

BACKGROUND OF THE INVENTION

Desirability of a watertight seal on a mask used for underwater diving is evident. Masks are designed to seal off the face from above the lip to above the eyes. The mask should also provide maximum visibility and comfort.

To test for proper fit, a diver places the mask against their face without a strap and breathes in. If the mask fits properly, it will remain on the face with no other support than the suction of breathing in. Typically, a supplier of masks must carry several sizes and styles to fit the many varied sizes and shapes of the human face.

U.S. Pat. No. 3,143,739, incorporated herein by reference, shows a face mask, which addresses the difficulty of obtaining a watertight seal by providing a specialized exhaust opening for removing water which seeps in.

U.S. Pat. No. 3,186,005, incorporated herein by reference, discloses a face mask which is designed to provide substantially unrestricted, distortion free visibility.

U.S. Pat. No. 4,112,521, discloses a quick adjust strap for a face mask. The strap attaches through a typical ring pivotally mounted within a hinge.

Presently, the problem of obtaining a good seal is addressed by use of an inner flap which extend around the perimeter of the soft part of the mask to form a second seal. This makes manufacture of the mask difficult and fails to address the difficulty of sizing.

The need exists for a mask which maximizes visibility, has a universal fit, and provides a good watertight seal.

SUMMARY OF THE INVENTION

The present face mask has a main lens unit and preferably two smaller lens units which lock and seal into a flexible mask body. The main lens rests in front of the face and the smaller lens units rest in pocket hinges at the side of the mask body. The mask body posterior to the pocket hinge rests behind the concave surface of the temple. The mask body contacting the head is concave, to act as a suction cup. A floating strap attaches to the mask body at the rear of the pocket hinge to pull the posterior of the hinge and a posterior flap toward the body in order to provide a universal fit and water tight seal.

DETAILED DESCRIPTION OF THE PREFERRED EMBODIMENTS

Figure 1:
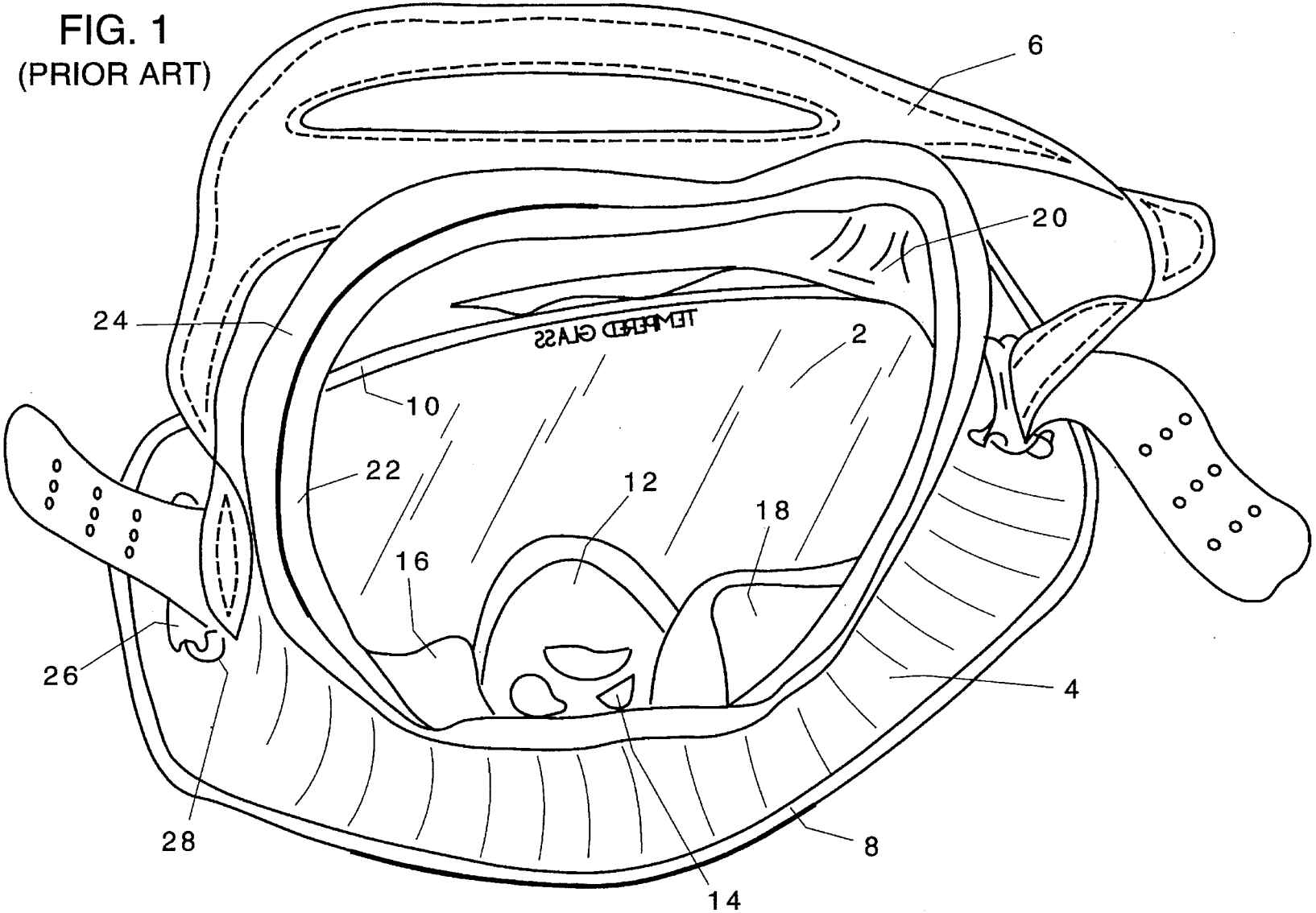
FIG. 1 (PRIOR ART)
FIG. 1 is a rear perspective view of a commercially available face mask.

FIG. 1 shows a commercially available mask having a face lens 2, mask body 4, and strap 6. The lens 2 is held onto the body 4 by a metal ring 8 and inner 10 and outer gaskets. Part of the inner gasket 10 forms a nasal pocket 12 which has a one way valve 14 attached. The mask body is made of a translucent, flexible silicone polymer and has two indentations 16, 18 for squeezing the nose to equalize pressure. The inner surface 20 of the mask curves inward towards the face forming a substantially convex surface. An inner flap 22 extends around the inner surface close to the perimeter and the outer portion of the main surface 26 which extends from the flap 22 is a substantially straight wall. On each side of the body is a holder 26 for pivotally retaining a C shaped ring 28. The ring 28 retains a strap 6 made of substantially the same material as the mask body.

Figure 2:
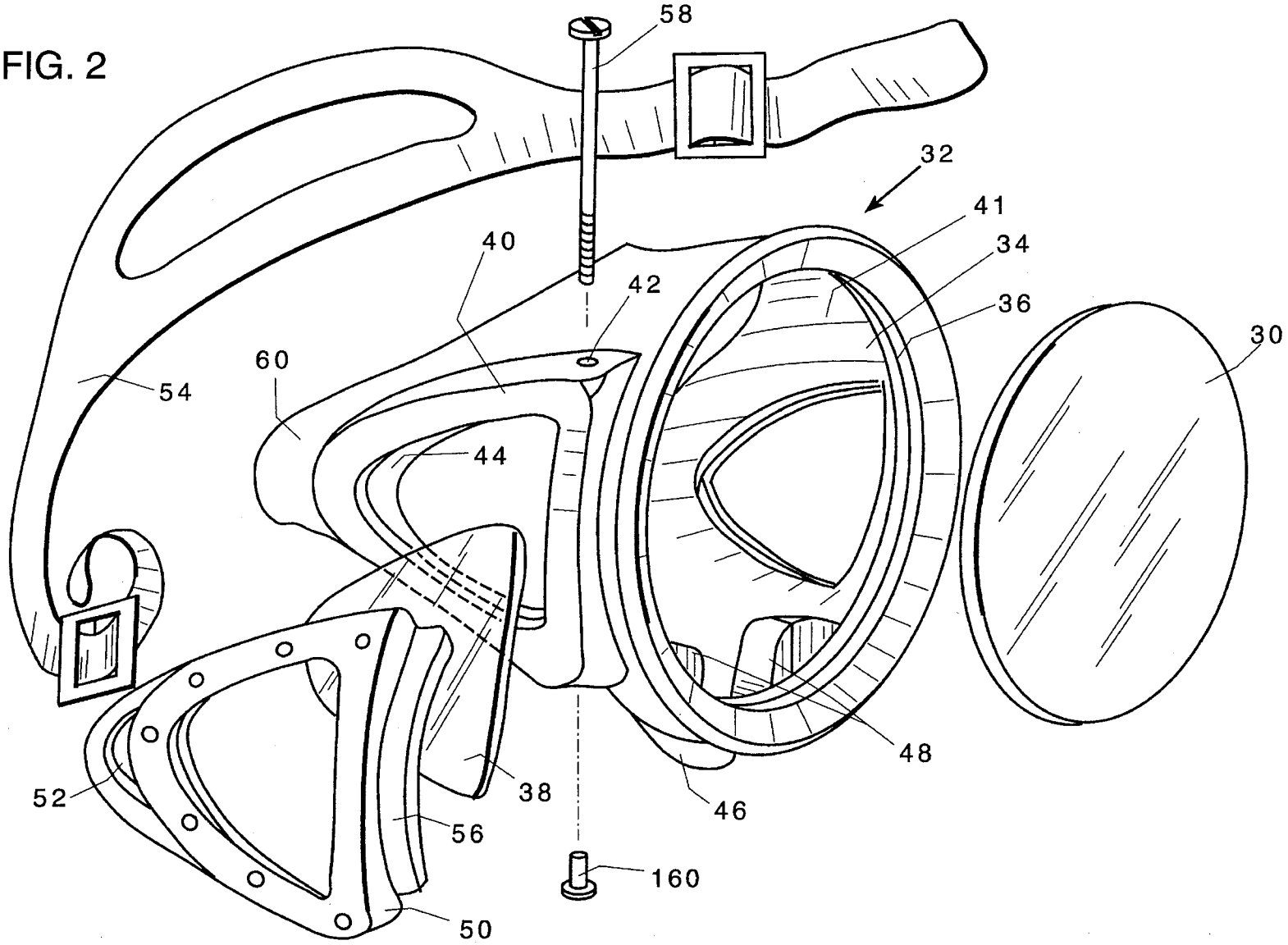
FIG. 2 is an exploded perspective view of a face mask according to the invention.
Figure 4:
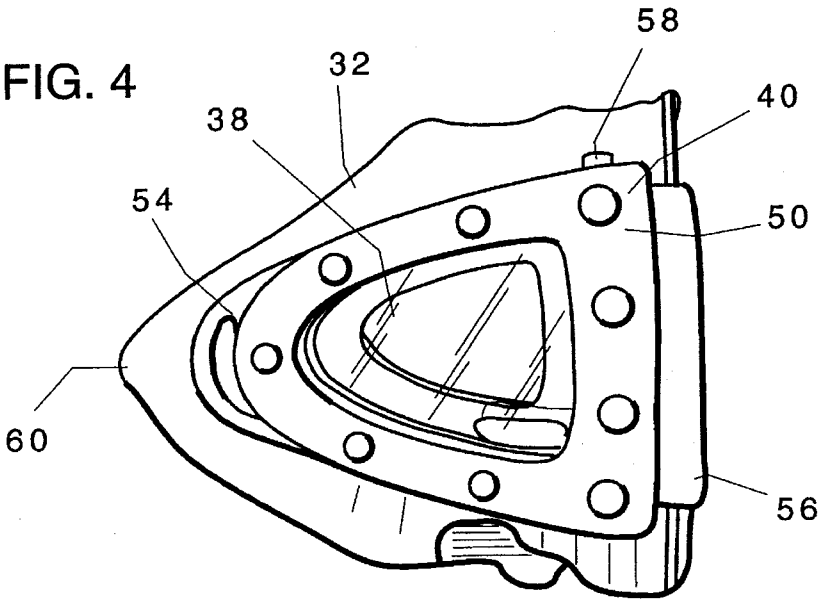
FIG. 4 is a side view of a face mask according to the invention without as strap.
Figure 3:
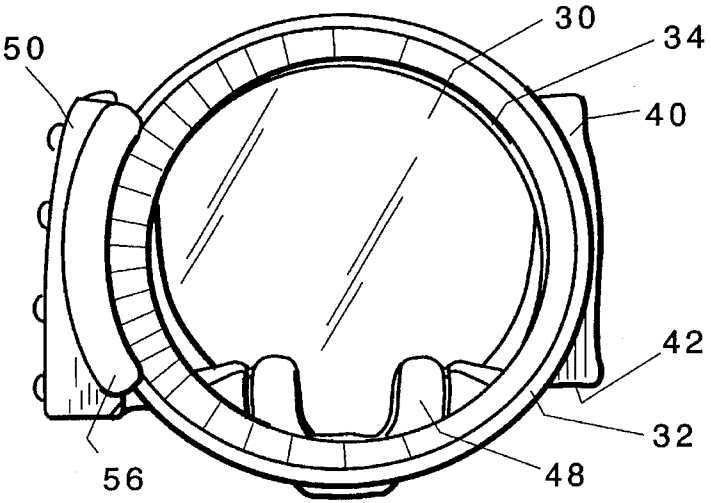
FIG. 3 is a front view of a face mask according to the invention.
Figure 5:
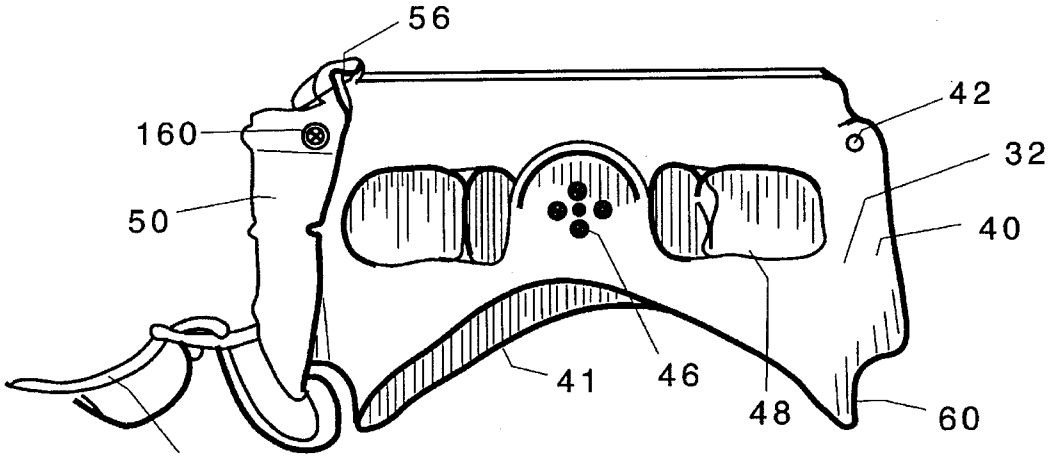
FIG. 5 is a bottom view of a face mask according to the invention.

FIG. 2 shows an exploded view of a preferred embodiment of the invention. A lens unit 30 is made of tempered glass or suitable transparent polymer. A flexible, somewhat elastic, soft mask body 32 has an opening 34 having a shape similar to lens unit 30. On the inner perimeter of the opening 34 is a groove 36 for receiving the lens unit 30. The thickness of the lens unit 30 is very slightly greater than the width of the groove 36, and the magnitude of the perimeter of the lens unit 30 is equal to or very slightly greater than the maximum perimeter of the groove. When the lens unit 30 is inserted, the mask body is very slightly stretched and forms a watertight seal without addition of a chrome ring. Each side of mask body 32 has a side lens unit 38 to provide a visual window on each side. The side lens unit 38 fits in a pocket hinge 40 similar to front lens unit 30 in opening 34. A pocket hinge is defined here as a pivotally attached member which has a depression or pocket comprising a wing of the hinge. The pocket hinge 40 is recessed from the inner surface 41 of the mask body 32 to provide better suction. A bore 42 passes through the solid anterior portion of the pocket hinge 40. Located over the pocket hinge 40 is a rigid frame 50 with a posterior strap opening 52. A strap 54 made of a closed foam cell material like closed cell neoprene passes through strap opening 52. This enables the strap 54 to float. A threaded pin 58 passes through a hole in the side of the frame 50, then through the bore 42, through a second hole in the frame 50 and is secured with a threaded end 160. This pin accentuates pivotal action of the pocket hinge 40. The mask is provided with a bellows type pressure equalizer 48 and a built in purge valve 46. The frame 50 has a curved lens holder 56 which better supports the front lens unit 30. The inner surface 41 is molded to a concave surface to act as a suction cup. Located behind the pocket hinges 40 are curved leading back edges meeting in a somewhat pointed structure 60.

The leading back edge 60 has a cross sectional area leading into a knife edge and has has an experimentally determined curve. To better describe the curve, the distance between several points is given in the following chart. Coordinates are taken from an set of coordinates having one axis (x) extending through the peaks behind the temple area, another axis (y) perpendicular to the x axis and parallel to the front lens. The third axis is perpendicular to the x and y axis. The coordinates represent distance in mm from the origin (0,0,0) define the curvature of one half of the back edge of the face mask. The remaining half has similar coordinates, except for a negative of the x coordinates.

TABLE OF BACKEDGE COORDINATES

| x | y | z | x | y | z |
|---|---|---|---|---|---|
| 0 | −5.5 | 5.1 | 0 | 5.5 | 5.6 |
| 1 | −5.9 | 4.9 | −1 | 5.4 | 5.4 |
| 1.8 | −5.5 | 4.5 | −2 | 5.2 | 5.3 |
| 2.6 | −4.8 | 4.1 | −3.0 | 5.0 | 5.1 |
| 3.4 | −3.0 | 3.4 | −3.7 | 4.4 | 4.8 |
| 4.2 | −2.3 | 2.4 | −4.5 | 3.7 | 4.1 |
| 4.5 | −2.0 | 2.0 | −4.9 | 3.3 | 3.5 |
| 4.9 | −1.5 | 1.5 | −5.4 | 3.1 | 2.7 |
| 5.2 | −1.1 | 0.9 | −5.5 | 2.9 | 1.7 |
| 5.6 | −0.9 | 0.6 | −5.8 | 2.2 | 1.0 |
| 6.0 | −0.1 | 0.5 | −6.0 | 1.1 | 0.4 |
| 6.1 | 0.0 | 0.0 | −6.1 | 0 | 0 |

The above mask, though smaller in span than the commercially available adult mask has been found to fit all those on whom it was tried from 4 years old to adult.

Since the leading back edges 60 conform to and contact the wearer's head behind the convex facial surface of the temples, it is easier to obtain and maintain a good seal. Sculpting the portion of the mask that meets the face into a concave shape increases suction action. This mask, unlike available masks is flexible from front lens 30 to the back lens 38.

When a wearer dons the mask, the strap 52 and frame 50 squeeze the mask to conform to the face and acts like a door hinge to open and close on the face. This frame 50 allows the mask to be flexible and acts as a hinge so the back of the face mask can conform to any size face. The frame 50 secures the frontal 30 and side 38 lens units, holds the strap 54, and allows more side vision. If a band or rigid frame encircles the frontal lens 30, hinge movement of the face mask would be restricted. The pocketed, recessed nature of the hinge 40 enables suction to be maintained under the hinge 40 during use.

Suitable materials for self sealing lenses include tempered glass, polycarbonates, and rigid acrylic polymers. Suitable materials for the mask body include silicone base polymers, polyethylenes, polypropylene. The preferred polymer is an ultraviolet resistant polymer available under the trade name KRAYTON because of its extensive elasticity, pliability, chemical resistance, memory, and tear resistance. For buoyancy, a closed cell material such as neoprene could be used and pliability. The strap can be made of any of the above materials but is preferably made of neoprene. The frame 50 may be made from a metal such as aluminium or a rigid plastic such as a hardened epoxy.

What is claimed is:

1. An underwater diving mask comprising:

a pliable body having means for forming an air tight seal to a wearer's face;

a frontal lens located anteriorly in said body; and a pair of pocket hinges located laterally in said body further comprising:

a pair of rigid frames over said pocket hinges.

2. The mask of claim 1 further comprising:

means for attaching a strap located on each of the posterior portions of said rigid frames; and a pair of pivot pins passing through anterior portions of said rigid frames and pocket hinges.

3. The mask of claim 2 wherein said pliable body has interior and exterior surfaces; and the posterior portion of said interior surface of said pliable body is substantially concave.

4. The mask of claim 3 further comprising:

a pair of side lenses located laterally in said body.

5. The mask of claim 4 wherein said pocket hinges and frames are substantially triangular in shape, and said pliable mask body further comprises:

a pair of substantially pointed extensions located behind said hinges; and wherein said pair of frames further comprises:

a pair of frontal lens holders.

6. The mask of claim 5 wherein said pliable mask body further comprises:

a frontal opening similar in shape to said lens, said frontal opening being provided with a groove on its interior perimeter for accepting said lens; and wherein said lens is dimensionally greater than said groove, so as to be self sealing.

* * * * *